US005199938A

United States Patent [19]

Kohlstette et al.

[11] Patent Number: 5,199,938

[45] Date of Patent: Apr. 6, 1993

[54] CENTRIFUGE DRUM FOR CONCENTRATING SUSPENDED SOLIDS

[75] Inventors: Werner Kohlstette; Aloys Bökamp; Friedhelm Siegmann, all of Oelde, Fed. Rep. of Germany

[73] Assignee: Westfalia Separator AG, Oelde, Fed. Rep. of Germany

[21] Appl. No.: 786,152

[22] Filed: Oct. 31, 1991

[30] Foreign Application Priority Data

Nov. 19, 1990 [DE] Fed. Rep. of Germany ..... 4036793

[51] Int. Cl.[5] ..... B04B 15/00; B04B 11/08

[52] U.S. Cl. ..... 494/10; 494/35; 494/58

[58] Field of Search ..... 210/371, 378; 494/10, 494/23, 27, 35, 37, 56, 57, 58

[56] References Cited

U.S. PATENT DOCUMENTS

| | | | |
|---|---|---|---|
| 1,923,454 | 8/1933 | Peltzer | 494/35 |
| 2,532,792 | 12/1950 | Svensjo | 494/35 |
| 3,070,291 | 12/1962 | Bergey | 494/10 |
| 3,408,000 | 10/1968 | Nilson | 494/10 |
| 3,563,453 | 4/1971 | Nilson | 494/37 |
| 3,580,493 | 5/1971 | Johnson | 494/37 |
| 3,586,484 | 6/1971 | Anderson | 494/10 |
| 3,640,452 | 2/1972 | Thylefors | 494/35 |
| 3,642,196 | 2/1972 | Nilsson | 494/10 |
| 3,752,389 | 8/1973 | Nilsson | 494/35 |
| 4,151,950 | 5/1979 | Gunnewig | 494/10 |
| 4,278,200 | 7/1981 | Gunnewig | 494/10 |
| 4,305,817 | 12/1981 | Kohlstette | 494/27 |
| 4,475,897 | 10/1984 | Bradtmoller | 494/35 |
| 4,525,155 | 6/1985 | Nilsson | 494/37 |
| 4,755,165 | 7/1988 | Gunnewig | 494/37 |
| 4,759,744 | 7/1988 | Krook | 494/35 |
| 4,820,256 | 4/1989 | Nordstrom | 494/35 |
| 4,834,890 | 5/1989 | Brown | 210/782 |
| 4,840,612 | 6/1989 | Pallmar | 494/10 |
| 4,911,833 | 3/1989 | Schoendorfer | 210/782 |
| 4,952,127 | 8/1990 | Schmeisser | 494/10 |
| 4,968,295 | 11/1990 | Neumann | 210/782 |

FOREIGN PATENT DOCUMENTS

| | | | |
|---|---|---|---|
| 8903251 | 4/1989 | PCT Int'l Appl. | 494/37 |

*Primary Examiner*—Philip R. Coe
*Assistant Examiner*—Terrance R. Till
*Attorney, Agent, or Firm*—Sprung Horn Kramer & Woods

[57] ABSTRACT

A centrifuge drum for concentrating suspended solids, which are conveyed through channels out of an outer solids space in the drum and into a radially inner peeling chamber, whence they are diverted by a peeler and by an associated concentrate line. A separated clear phase is continuously extracted from the interior of the drum by another peeler and by an associated clear-phase line. The object is to prevent the concentrated solids from heating up undesirably even when their volume is small. There is an opening-and-closing communicating line between the concentrate line and the clear-phase line and an opening-and-closing recirculation line extending into the first peeling chamber from the clear-phase line. The communicating line and the recirculation line are closed to divert the solids and opened to discontinue the diversion.

3 Claims, 1 Drawing Sheet

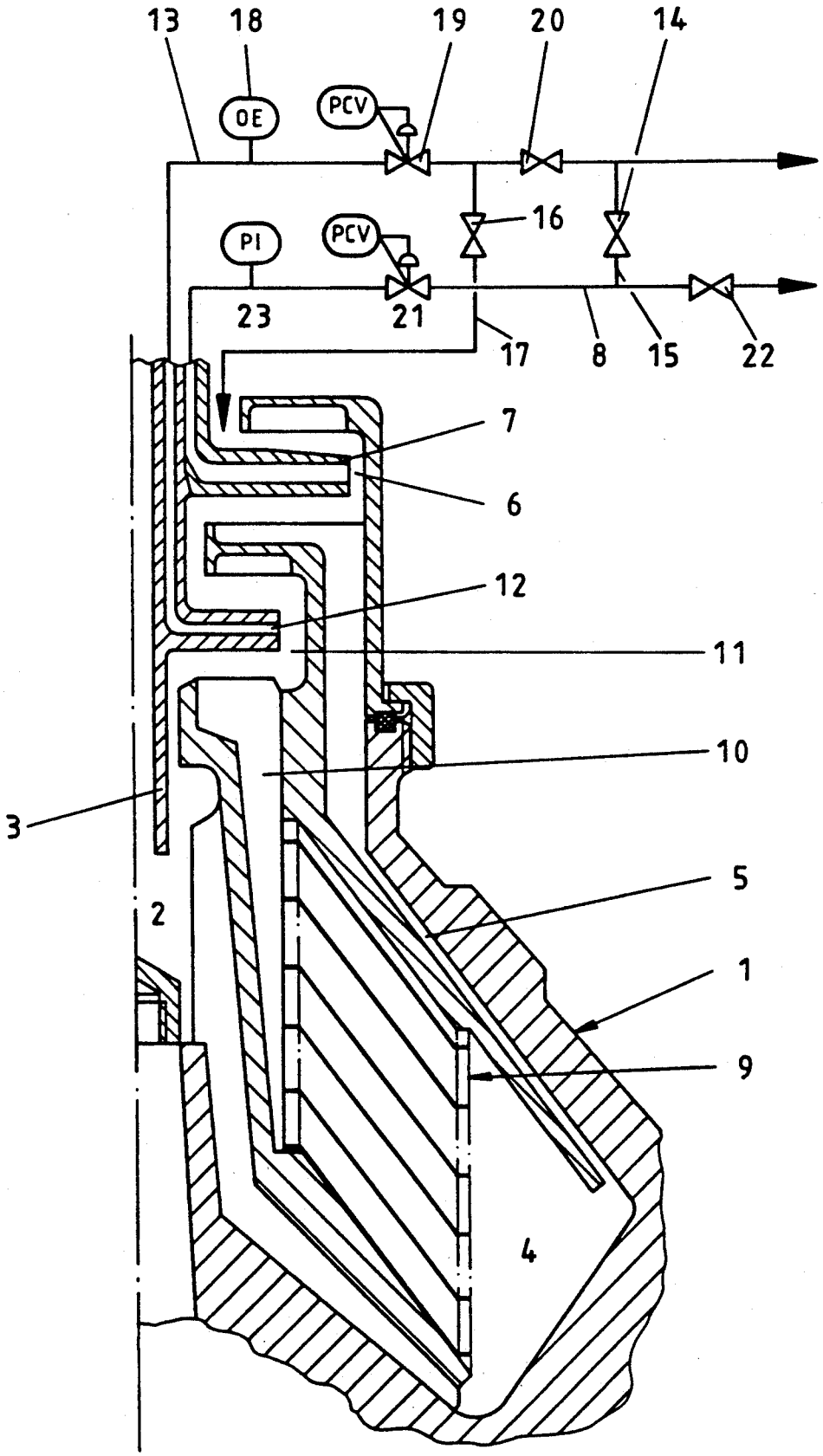
13
18
19
20
14
OE
PCV
16
PI
PCV
23
21
17
8
15
22
7
6
12
11
10
3
5
2
1
9
4

CENTRIFUGE DRUM FOR CONCENTRATING SUSPENDED SOLIDS

BACKGROUND OF THE INVENTION

The invention concerns a centrifuge drum for concentrating suspended solids, which are conveyed through channels out of an outer solids space in the drum and into a radially inner peeling chamber, whence they are diverted by a peeler and by an associated concentrate line, whereby a separated clear phase is continuously extracted from the interior of the drum by another peeler and by an associated clear-phase line.

A similar drum is known from German 2 701 624 C2. The first peeler in the known drum constantly diverts concentrated solids out of the drum. The stationary peeler immerses itself for this purpose in the concentrated solids, which are rotating within the peeling compartment at the same speed as the drum, converting the energy of rotation into feed pressure. Friction generates heat where the concentrated solids come into contact with the peeler, and the heat transfers to the concentrate. When the solids are insensitive to heat or when there is a lot of them, the heating is either safe or negligibly slight. In biochemistry, however, the concentrates are often of living cells and highly sensitive to heat. Their volume is also often very low. In either case the heat of friction can be very detrimental or even intolerable. These conditions occur both when a small volume of solids is continuously extracted and when a large volume is extracted periodically and rapidly.

In the latter situation the concentrate line must be turned off after each extraction. The peeler, which is still immersed in the liquid in the peeling compartment, can become hot between the periodic diversions, in which case any contact between it and sensitive solids during the next diversion will be highly detrimental.

SUMMARY OF THE INVENTION

The object of the present invention is accordingly to improve the known drum to the extent that the concentrated solids will not heat up undesirably even when their volume is small.

This object is attained in accordance with the invention by an opening-and-closing communicating line between the concentrate line and the clear-phase line and by an opening-and-closing recirculation line extending into the first peeling chamber from the clear-phase line, whereby the communicating line and the recirculation line are closed to divert the solids and opened to discontinue the diversion.

A large enough volume of solids is periodically diverted out of the drum to prevent them from heating up unacceptably. The communicating line and the recirculation line are both closed during this phase. The diversion is discontinued by opening both lines. Enough clear phase will now enter the first peeling chamber through the recirculation line to exploit the total prescribed forwarding capacity of the first peeler. No more solids will be able to enter the first peeling chamber. The clear phase entering the first peeling chamber will return to the clear-phase line through the first peeler and the communicating line, cooling the peeler and preventing it from heating up dangerously.

One advantageous embodiment of the invention has pressure controls in the concentrate line. The controls establish the requisite pressures for diverting the solids and for discontinuing the diversion.

Another advantageous embodiment of the invention has a photoelectric cell in the clear-phase line that monitors the level of transparency in the drum and emits a pulse when the solids compartment fills up and the transparency decreases. The pulse initiates solids extraction for a prescribed period.

The invention will now be described with reference to the embodiment illustrated in the drawing by way of example.

BRIEF DESCRIPTION OF THE DRAWING

The FIGURE is a cross sectional view of a centrifuge drum connected in a system in accordance with the present invention.

DETAILED DESCRIPTION OF THE INVENTION

The intake compartment 2 of a centrifuge drum 1 communicates with a stationary feed pipe. Channels 5 extend from the drum's solids compartment 4 into a peeling chamber 6 that accommodates a peeler 7. Peeler 7 communicates with a concentrate line 8. Drum 1 also accommodates a stack of disks 9. Channels 10 extend from the center of disks 9 into another peeling chamber 11 that accommodates a second peeler 12. Second peeler 12 communicates with a clear-phase line 13. A communicating line 15 accommodating a shut-off valve 14 extends from the clear-phase line 13 to concentrate line 8. A recirculation line 17 accommodating another shut-off valve 16 extends from clear-phase line 13 to first peeling chamber 6. Clear-phase line 13 also accommodates a photoelectric cell 18, pressure controls 19, and another shut-off valve 20. Concentrate line 8 also accommodates pressure controls 21, a shut-off valve 22, and a manometer 23.

Feed is supplied to drum 1 by way of a pipe 3. Any solids suspended in the material are separated out by disks 9 and accumulate in solids compartment 4. The clear phase is conveyed out of the center of disks 9 and into second peeling chamber 11 by way of channels 10 and diverted out of the drum by way of second peeler 12 and clear-phase line 13. Some or all of the clear phase diverted through clear-phase line 13 is conveyed through the open shut-off valve 16 in recirculation line 17 into first peeling chamber 6 in order to discontinue the extraction of solids by way of channels 5 until solids compartment 4 is completely occupied by solids, when shut-off valve 20 is partly or completely shut off. Unillustrated controls establish the threshold for pressure controls 21 high enough in terms of the prescribed rate of clear-phase flow into first peeling chamber 6 during this procedure to displace the free level of liquid in the chamber radially inward, eliminating any forwarding pressure difference at the entrance into channels 5 and preventing any flow into the channels. The clear phase supplied to first peeling chamber 6 is returned to the clear-phase line by way of first peeler 7 and through the open shut-off valve 14 in communicating line 15. Shut-off valve 22 is closed during this procedure. First peeler 7 always has clear phase flowing through it and cooling it. Once solids compartment 4 has enough solids in it for particles to be diverted along with the clear phase, photoelectric cell 18 will emit a pulse that will close shut-off valves 14 and 16, open shut-off valve 20 and shut-off valve 22, and decrease the threshold of pressure controls 21 for a prescribed period of time. The decrease in the pressure in concentrate line 8 will allow solids to be extracted from solids compartment 4 at a higher rate, preventing them from heating up significantly. The initially described activities on the part of the controls will be resumed immediately after the solids have been extracted.

What is claimed is:

1. A centrifuge drum for concentrating suspended solids, comprising: means forming a radially outer solids space and a radially inner peeling chamber, means defining channels through which solids are conveyed from the outer solids space and into the radially inner peeling chamber, a first peeler in the peeling chamber for diverting solids from the peeling chamber, a concentrate line associated with the first peeler for receiving the diverted solids, a second peeler for continuously extracting a separated clear phase from the interior of the drum, a clear-phase line associated with the second peeler for receiving the extracted clear-phase, means forming an openable and closable communicating line between the concentrate line and the clear phase line for providing a fluid path therebetween when the communicating line is open, means forming an openable and closable recirculation line extending into the first peeling chamber from the clear-phase line for providing a fluid path therebetween when the recirculation line is open and means for controlling the opening and closing of the communicating line and the recirculation line to divert the solids when the communicating line and the recirculation line are closed whereby concentrate and clear phase are discharged separately and feed clear phase from the clear phase line to the first peeling chamber and then back to the clear phase line when the communicating line and the recirculation line are open, whereby only pure clear phase is discharged.

2. The drum as in claim 1, further comprising pressure controls in the concentrate line.

3. The drum as in claim 1, wherein the means for controlling comprises a photoelectric cell in the clear-phase line to monitor the level of transparency in the drum.

* * * * *